US008382084B2

(12) United States Patent
Gerber et al.

(10) Patent No.: US 8,382,084 B2
(45) Date of Patent: Feb. 26, 2013

(54) CENTERING DEVICE FOR FLAT WORKPIECES IN A PRESS AND METHOD FOR ADJUSTING SUCH A CENTERING DEVICE

(75) Inventors: Markus Gerber, Niederönz (CH); Adrian Stauffer, Langenthal (CH); Martin Müller, Willisau (CH)

(73) Assignee: Gudel Group AG, Langenthal (CH)

( * ) Notice: Subject to any disclaimer, the term of this patent is extended or adjusted under 35 U.S.C. 154(b) by 282 days.

(21) Appl. No.: 12/598,928

(22) PCT Filed: Feb. 19, 2008

(86) PCT No.: PCT/CH2008/000070

§ 371 (c)(1),
(2), (4) Date: Apr. 19, 2010

(87) PCT Pub. No.: WO2008/134904

PCT Pub. Date: Nov. 13, 2008

(65) Prior Publication Data

US 2010/0225035 A1 Sep. 9, 2010

(30) Foreign Application Priority Data

May 8, 2007 (EP) ..... 07405136

(51) Int. Cl.
*B23Q 1/25* (2006.01)

(52) U.S. Cl. ..... 269/55; 269/60; 269/289 R

(58) Field of Classification Search ..... 269/289 R, 269/37, 42, 55–58, 60; 108/139, 94, 140, 108/137, 143; 29/2.2, 2.21, 279, 281.1, 281.4, 29/281.6, 559; 451/285–288; 318/640; 248/416, 248/425; 198/379, 394, 395, 414; 271/4.03, 271/226, 3.15; 221/156, 173; *B21D 43/00, B21D 43/14, 43/05, 43/18; B30B 15/30*
See application file for complete search history.

(56) References Cited

U.S. PATENT DOCUMENTS 1,208,457 A * 12/1916 Bellville ..... 108/94

(Continued)

FOREIGN PATENT DOCUMENTS

DE 196 39 590 A1 4/1998
DE 19809184 A1 * 10/1998

(Continued)

OTHER PUBLICATIONS

Vertical. (2012). Hyperdictionary.com. Retrieved May 9, 2012, from http://www.hyperdictionary.com/search.aspx?define=vertical.*

(Continued)

*Primary Examiner* — Lee D Wilson
*Assistant Examiner* — Tyrone V Hall, Jr.
(74) *Attorney, Agent, or Firm* — Birch, Stewart, Kolasch & Birch, LLP

(57) ABSTRACT

A centering device (1) for flat workpieces, especially sheet-metal blanks to be processed in a press, comprises a first table, which can be rotated about a first vertical axis, for receiving a workpiece and a second table, which can be rotated about a second vertical axis, for receiving a workpiece. The second table is arranged to the side of the first table, and a support level of the first table coincides substantially with a support level of the second table. The device furthermore comprises a rotation mechanism coupled mechanically to the first table and to the second table allowing the first and the second tables to be rotated jointly about a third vertical axis to form a common supporting surface. In an alternative operating mode, the tables are rotated individually about the spaced vertical axes of rotation and thus move relative to one another.

11 Claims, 7 Drawing Sheets

U.S. PATENT DOCUMENTS

| | | | | | |
|---|---|---|---|---|---|
| 1,254,983 | A | * | 1/1918 | Chadwick | 108/22 |
| 1,343,648 | A | * | 6/1920 | Smith | 198/690.1 |
| 2,549,083 | A | * | 4/1951 | Hamilton | 108/21 |
| 2,855,197 | A | * | 10/1958 | Nash | 271/18.2 |
| 3,495,519 | A | * | 2/1970 | Bluitt et al. | 108/137 |
| 3,897,063 | A | * | 7/1975 | Lehwalder | 273/280 |
| 4,191,916 | A | * | 3/1980 | Zasio et al. | 318/640 |
| 4,284,033 | A | * | 8/1981 | del Rio | 118/730 |
| 4,768,698 | A | * | 9/1988 | Brown et al. | 228/18 |
| 5,109,989 | A | * | 5/1992 | Kremmin et al. | 211/1.55 |
| 5,293,984 | A | | 3/1994 | Lucas | |
| 5,523,941 | A | * | 6/1996 | Burton et al. | 700/60 |
| 5,562,049 | A | * | 10/1996 | Hoffman et al. | 108/94 |
| 5,969,441 | A | * | 10/1999 | Loopstra et al. | 310/12.06 |
| 6,271,140 | B1 | * | 8/2001 | Chang | 438/692 |
| 6,279,490 | B1 | * | 8/2001 | Pastor | 108/94 |
| 6,553,653 | B2 | * | 4/2003 | Hulings et al. | 29/712 |
| 6,891,341 | B2 | * | 5/2005 | Cho | 318/34 |
| 7,008,293 | B2 | * | 3/2006 | Kurogouchi | 451/2 |
| 7,011,305 | B2 | * | 3/2006 | Forch et al. | 271/226 |
| 7,032,738 | B2 | * | 4/2006 | Tonnigs et al. | 198/463.3 |
| 7,037,174 | B2 | * | 5/2006 | Chen et al. | 451/5 |
| 2004/0012768 | A1 | * | 1/2004 | Tanaka et al. | 355/72 |
| 2004/0082285 | A1 | * | 4/2004 | Bohler | 451/359 |

FOREIGN PATENT DOCUMENTS

| | | | | |
|---|---|---|---|---|
| DE | 10 2004 051 994 | A1 | | 4/2006 |
| DE | 102004051994 | A1 | * | 4/2006 |
| EP | 0 546 424 | A1 | | 6/1993 |
| EP | 0 865 331 | B1 | | 4/2000 |
| FR | 2797602 | A1 | * | 2/2001 |
| JP | 10109200 | A | * | 4/1998 |
| JP | 11244968 | A | * | 9/1999 |
| SU | 1326376 | A1 | | 7/1987 |

OTHER PUBLICATIONS

Control System. (2012). Hyperdictionary.com. Retrieved May 9, 2012 from http://www.hyperdictionary.com/search.aspx? define=control+system.*

System. (2012). Hyperdictionary.com. Retrieved May 9, 2012 from http://www.hyperdictionary.com/search.aspx?define=system.*

* cited by examiner

CENTERING DEVICE FOR FLAT WORKPIECES IN A PRESS AND METHOD FOR ADJUSTING SUCH A CENTERING DEVICE

FIELD OF THE INVENTION

The invention relates to a centering device for flat workpieces, in particular sheet-metal blanks to be processed in a press. The invention furthermore relates to a method for setting up a centering device.

DESCRIPTION OF RELATED ART INCLUDING INFORMATION DISCLOSED UNDER 37 CFR 1.97 AND 1.98

Pre-blanked sheet-metal parts or "blanks" are often processed further in a press (e.g. a multi-station press or press line). Before actual processing takes place in the press, the blanks supplied must generally be unstacked or separated, washed and, if required, oiled. To allow the blanks to be processed further in a precise manner in the press, they must be precisely positioned and oriented in a predetermined alignment after the operations mentioned and before being introduced into the press.

Positioning and alignment are frequently performed with known centering stations, which have mechanical slides and stops against which the blank can be aligned. However, these have the disadvantage of requiring manual conversion when the type of blank is changed, a complex procedure involving repositioning and re-orienting the slides and stops. Moreover, when processing irregularly shaped sheets or a plurality of small sheets, a large number of slides and stops is required to ensure correct positioning.

Automatic solutions have been developed to counter the disadvantages mentioned, especially for cases where the type of blank to be processed in a press changes frequently.

EP 865 331 B1 (Reinhardt Maschinenbau GmbH), for example, describes a bending center and a method of presenting a sheet-metal part to a bending cell of the bending center. After the position of the sheet-metal part has been determined by means of a sensor, it is positioned exactly in one direction by means of a manipulator as it is introduced into the bending cell. Provision is made for the sensor to be moved in two different directions to enable the position of the sheet-metal part to be determined in both directions and its angular misalignment to be determined with the minimum number of sensors. It is also described as advantageous to attach the sensor to the manipulator arrangement in order to exploit the mobility of the latter. In addition to a manipulator that can be moved in a first direction, this document describes a second manipulator, which can operate simultaneously with the first manipulator and can be moved in a second direction. The sensor for determining the position of the sheet-metal part is embodied, inter alia, as a light barrier, arranged in a fork, for detecting the edges of the sheet-metal part.

However, the overall length of this arrangement is large because the manipulators are arranged in series. Moreover, it is limited to the simultaneous positioning of one sheet-metal part in each case.

U.S. Pat. No. 5,293,984 (Bobst S. A.) describes a device for preparing and aligning bundled flat workpieces. It describes a transport device comprising sets of several driven rollers. A table with moving balls can be moved upwards, downwards and sideways between the rollers.

This device is of very complex construction and, once again, is limited to the simultaneous positioning of individual workpieces.

W. Strothmann GmbH, Schloss Holte-Stukenbrock (Germany) offers a loading feeder with an integrated image recognition and processing system, which matches the position of the blank to the specified values as it is transferred into the press. The system is based on whiplash loading feeders, which can not only traverse along the conventional axes but can also perform rotary movements about the u axis, allowing precise control of the angular alignment of the sheets. The actual optical centering system comprises a camera and the image recognition and processing platform, which is linked to the CNC control system of the feeder. While the blank is being transported on the conveyor belt upstream of the press, the optical system detects its position, enabling the loading feeder to pick up the component in an appropriate manner. To specify a new target position, a workpiece must be placed correctly in the press just once, then removed by the feeder and deposited under the camera for detection without a change in position.

However, this solution requires the use of a specific loading feeder of complex construction, which must furthermore be matched to the press. For example, the travel geometry of the loading feeder must be such that the workpieces to be processed can be transported to the target position in the press through an appropriate press aperture. Moreover, a single loading feeder can perform just one position and/or angle correction during loading; if the requirement is to change the position and/or orientation of a plurality of workpieces independently of one another, a plurality of loading feeders is needed.

BRIEF SUMMARY OF THE INVENTION

It is the object of the invention to provide a centering device belonging to the technical sphere mentioned at the outset which is of simple construction and can re-orient a plurality of workpieces simultaneously.

The solution to the object is defined by the features of claim 1. According to the invention, the centering device comprises a) a first table, which can be rotated about a first vertical axis, for receiving a workpiece;

b) a second table, which can be rotated about a second vertical axis, for receiving a workpiece, the second table being arranged to the side of the first table, and a support level of the first table coinciding substantially with a support level of the second table; and c) a rotation mechanism, which is coupled mechanically to the first table and to the second table in such a way that the first and the second tables can be rotated jointly about a third vertical axis.

If both tables are rotated jointly about the third vertical axis, the tables form a common supporting surface. In this operating mode, the tables are stationary relative to one another during rotation and the supporting surface is thus rotated as a whole. In the other operating mode, the tables are rotated individually about spaced vertical axes of rotation; the tables and their supporting surfaces thus move relative to one another.

With the device according to the invention, it is thus possible, without conversion work, to correctly orient either an individual workpiece, which can take up the entire width of the centering device, or two narrower workpieces at the same time for subsequent processing. The axes of rotation make it possible to correct the angular position of the workpieces in such a way that they can be picked up, by a loading feeder of simple construction for example, and transferred to the next processing station. The invention is not limited to devices with precisely two tables but can be generalized to cover embodiments with three or more tables.

The centering device according to the invention advantageously comprises a control system which can be switched between a first operating mode and a second operating mode. In the first operating mode, orientation of large workpieces supported by both tables is performed by rotating both tables about the third axis, and, in the second operating mode, two relatively small workpieces, each supported by one of the tables, are oriented simultaneously by a procedure in which angular positioning of the two workpieces is performed independently by rotating the tables about the first and the second axes respectively. It is thus possible to change between the two operating modes by a simple switching process. Manual conversion work is unnecessary.

The rotation mechanism is preferably formed by a support which is mounted on a machine frame in such a way that it can be rotated about the third vertical axis and which supports both the first table and the second table. This allows simple construction and simple control of the device; in the first operating mode (rotation of both tables), the support is rotated about the third vertical axis together with both tables, while the tables are not moved relative to the support; in the second operating mode (individual rotary movements), the support stands still while the tables are rotated relative to the support.

As an alternative, the tables are mounted to allow movement relative to a plurality of axes in such a way that they can perform a mutually synchronous movement about the third vertical axis by superposition of movements relative to these axes, even when there is no physical axis of rotation at the location of the third axis. Such kinematics can be implemented, for example, by means of two mutually perpendicular horizontal linear axes and a vertical axis of rotation, it being unnecessary that the axis of rotation should coincide with the third vertical axis.

The first table and the second table advantageously comprise a device for linear movement of the workpieces in a direction transverse to a feed direction. This allows individual corrections to the position of the workpieces in a transverse direction.

For this purpose, the first table and the second table are advantageously mounted on the rotation mechanism in such a way that they can be moved transversely. The tables can thus be moved independently of one another in a transverse direction relative to the rotation mechanism.

If a single workpiece which takes up the supporting surfaces of both tables needs to be positioned in a transverse direction, the abovementioned devices for linear movement of the workpieces in a transverse direction can be moved synchronously with one another, or there is an additional device by means of which both tables are moved simultaneously, e.g. a device which acts on the rotation mechanism, in particular on the abovementioned support on which both tables are mounted.

Depending on the requirements of the downstream processing unit or of a loading feeder, centering devices which do not perform any corrections of the transverse position and thus do not require a device for linear movement of the workpieces in a transverse direction are also conceivable.

The first table and the second table preferably comprise a device for linear movement of the workpieces in a feed direction (longitudinal direction). This enables the workpieces to be positioned correctly in the feed direction as well. The loading feeder or some other transfer element can thus always take over the workpiece at the correct longitudinal position, allowing very simple construction and control of the feeder or element. It is particularly advantageous if the device according to the invention comprises both a device for linear movement of the workpieces in a transverse direction and a device for linear movement of the workpieces in a longitudinal direction. This is because in this case a workpiece can be placed ready on the support level in a precisely defined position and orientation, and the loading feeder or the transfer element can take over all the workpieces at this precisely defined position and transport them to the subsequent processing station, in the simplest case while retaining their orientation.

The device for linear movement of the workpieces in the feed direction is preferably formed by magnetic belts. This makes it possible to transport metallic workpieces, e.g. sheets to be formed, reliably and at high speed. The belts furthermore enable the workpieces to be picked up in a simple manner from an upstream transport device and allow transport movements beyond the actual supporting surfaces of the tables. As an alternative, it is possible to use devices of different construction, e.g. conventional conveyor belts or conveyor slats, on which the workpieces are held by friction or by positive engagement.

The two tables advantageously have spaced supporting elements, each arranged on one side in mutually opposite sections, which are arranged in such a way that they mesh in a region between the two tables and thereby form a supporting surface between the tables. This supporting surface, the support level of which coincides with the support levels of the two tables, prevents large workpieces supported by both tables from buckling or sagging and at the same time allows unhindered relative movements (rotations and/or linear movements) between the two tables. The supporting elements are, for example, of elongate design and extend alternately in a transverse direction from the first and from the second table. Their length and breadth are chosen in such a way that they do not collide with one another or with the opposite table even when the tables are closest together and the relative angle of rotation is at its maximum. It is particularly advantageous if the supporting elements have freely rotatable rollers or balls or a surface with an anti-friction coating to ensure that they pose the minimum possible resistance to movements of the workpieces on the supporting surface.

As an alternative, a supporting surface between the tables can be formed by elements of some other kind, e.g. by elements which are connected firmly to a base of the device or to an element arranged under the tables. If the only workpieces being processed in a plant are those with a certain minimum rigidity, a supporting surface between the tables may be completely unnecessary.

The centering device according to the invention preferably comprises a detection device for detecting a position and an orientation of a workpiece supplied. The position and orientation of the workpiece can then be corrected by the centering device on the basis of this acquired information.

The detection device is advantageously formed by a line scanner, which is arranged ahead of the first and the second tables in the feed path of the workpieces and extends in a transverse direction across a feed track for the workpieces. The position and orientation of the workpieces are thus detected by the line scanner while they are being fed in. The line scanner can be of simple construction, allows precise detection of position and orientation and, in contrast to other detection devices, e.g. video cameras, does not require complex image processing.

The centering device advantageously comprises a control device which is designed and programmed in such a way that it can use a light/dark profile of the workpiece detected by the line scanner to determine the position correction and angle correction to be performed by means of the rotatable tables. Recording a light/dark profile which reproduces the outer and, where applicable, inner contours of the workpiece provides data that can be processed easily and which allow precise positioning and orientation of the workpiece. In particular, the profile detected can be compared with the desired profile which represents the position and orientation expected by the downstream processing station or downstream loading feeder. Deviations between the light/dark profile and the desired profile are evaluated by the control system in a manner known per se and converted into corrections to be performed, e.g. corrections in the angle of rotation and in the longitudinal and transverse directions. The corrections are then implemented by the rotatable tables and the devices for transverse and longitudinal motion, ensuring that the workpiece corresponds to the desired profile in its final position and orientation.

The desired profile of a workpiece is generated in the context of setting up the centering device, preferably as follows:

a) First of all, a workpiece of the type to be centered is placed in a target position in a processing station, the processing station being arranged downstream of the centering device.
b) The workpiece is then transported across the centering table and through the detection device counter to the feed direction by operating transport devices assigned to the processing station, the centering device and/or the detection device in reverse.
c) The position and orientation of the workpiece are then detected by means of the detection device, after which a desired profile, which corresponds to the detected position and orientation of the workpiece can be produced.

Depending on configuration, the transport devices mentioned can also include the loading feeder; the decisive point is that all the devices involved that have a predetermined effect on the position and/or orientation of the workpiece during transport between the detection device and the processing station should be operated in reverse. The centering table is advantageously passive during set-up, i.e. does not perform any rotations or linear movements. In principle, however, the centering table can perform predetermined movements; these must then merely be taken into account in the calculation of the desired profile, in equalizing the desired profile and the detected profile, and/or in the calculation of the corrections to be carried out.

Further advantageous embodiments and combinations of features of the invention will emerge from the following detailed description and from the patent claims, taken in their entirety.

BRIEF DESCRIPTION OF THE DRAWINGS

In the drawings used to explain the exemplary embodiment.

In all cases, identical parts are provided with identical references in the figures.

DETAILED DESCRIPTION OF THE INVENTION

Figure 1:
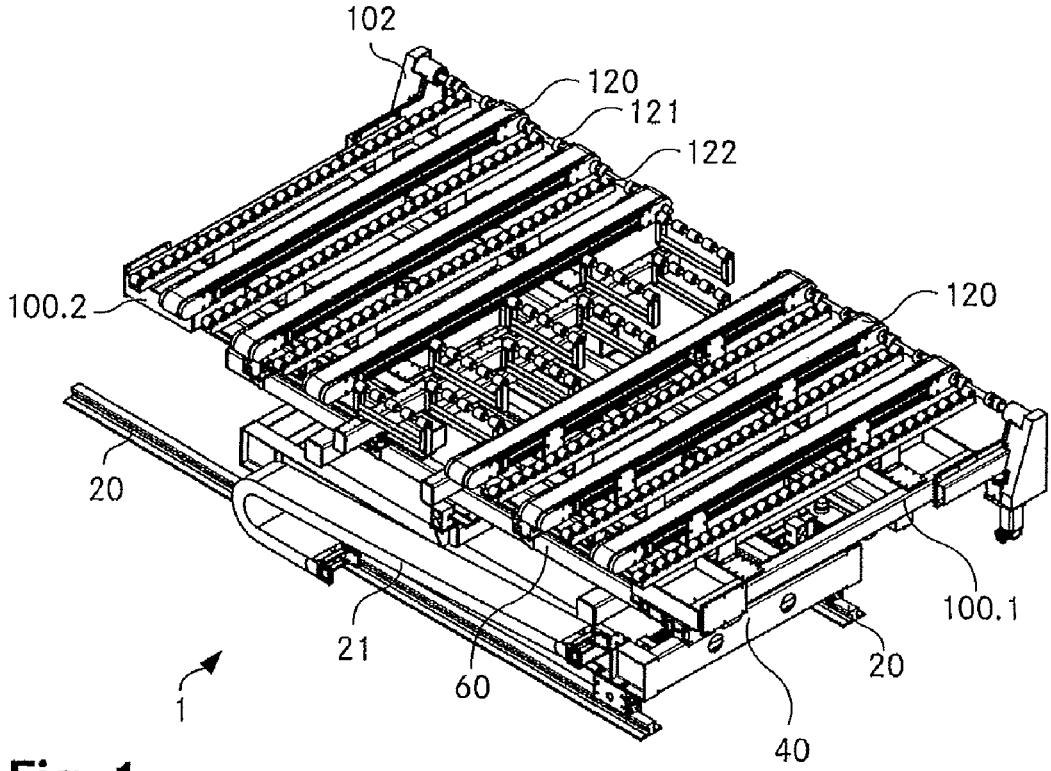
FIG. 1 shows a first oblique view of a centering device according to the invention.
Figure 2:
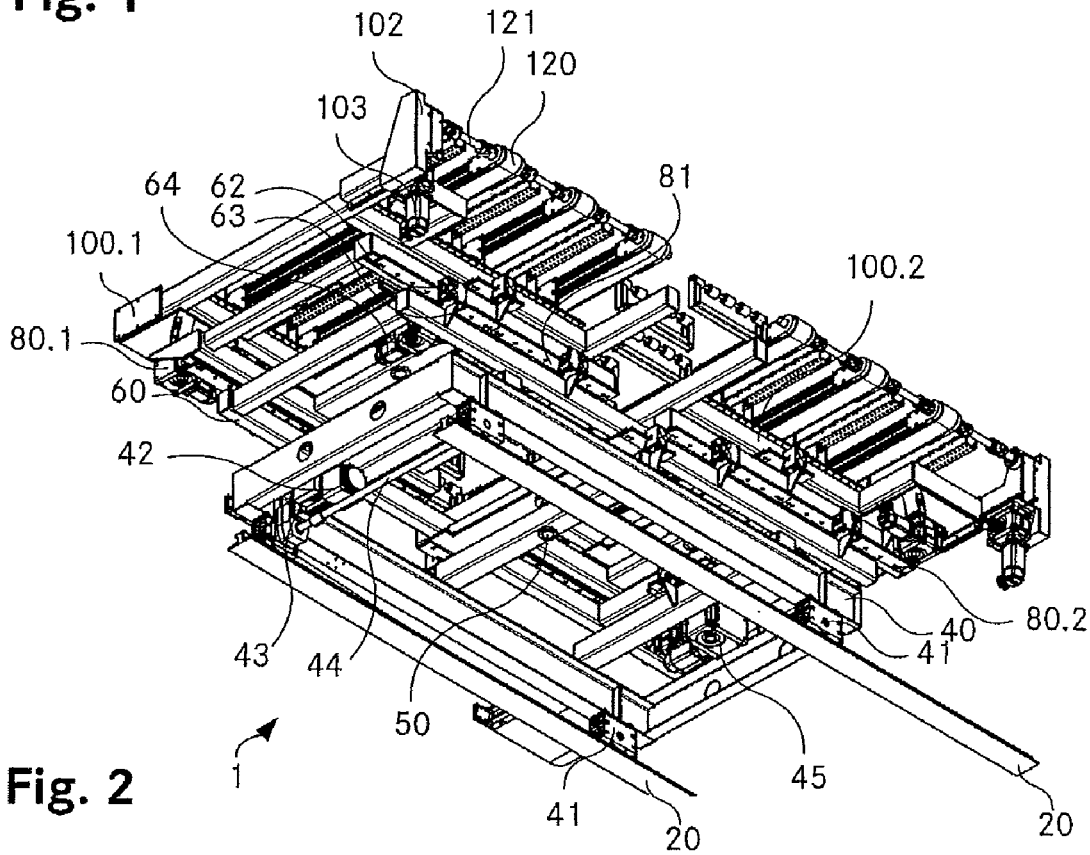
FIG. 2 shows a second oblique view of the centering device.
Figure 3:
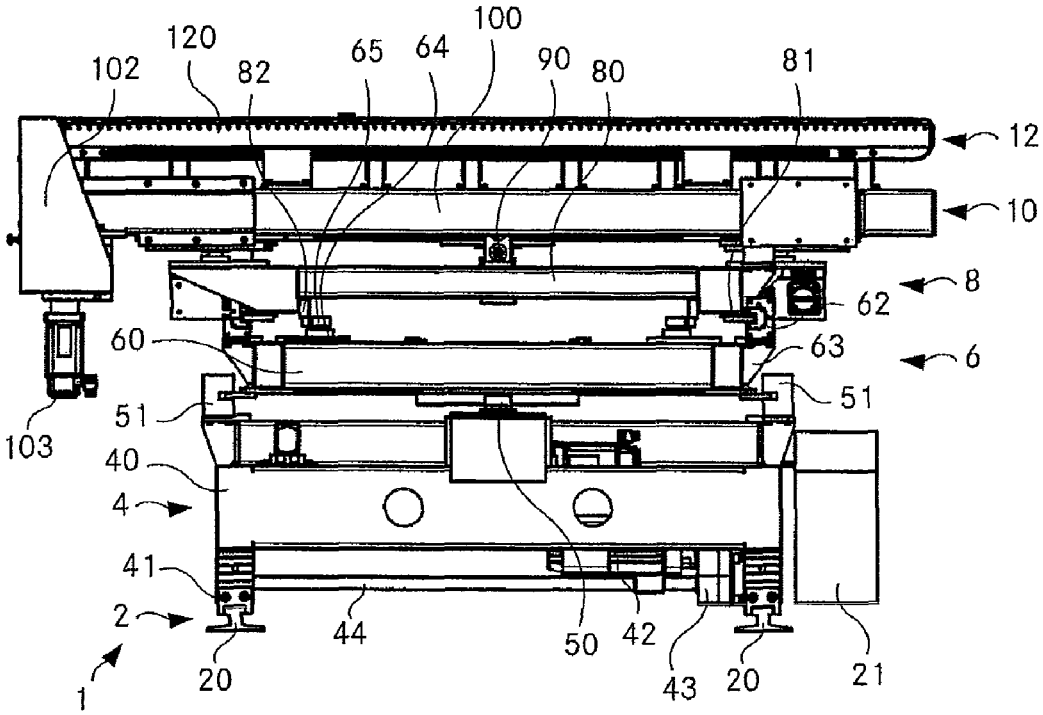
FIG. 3 shows an elevation of the centering device in a direction transverse to the feed direction.
Figure 4:
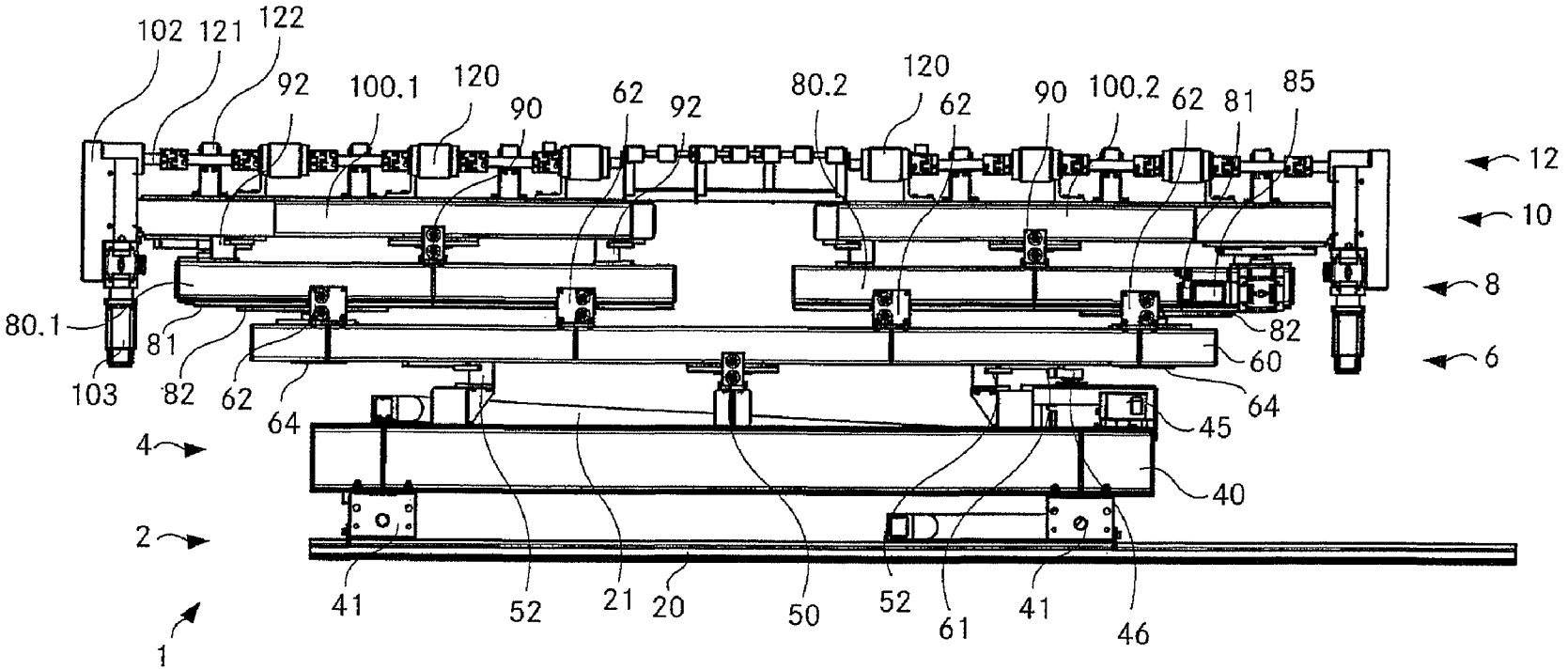
FIG. 4 shows an elevation of the centering device in the feed direction.
Figure 5:
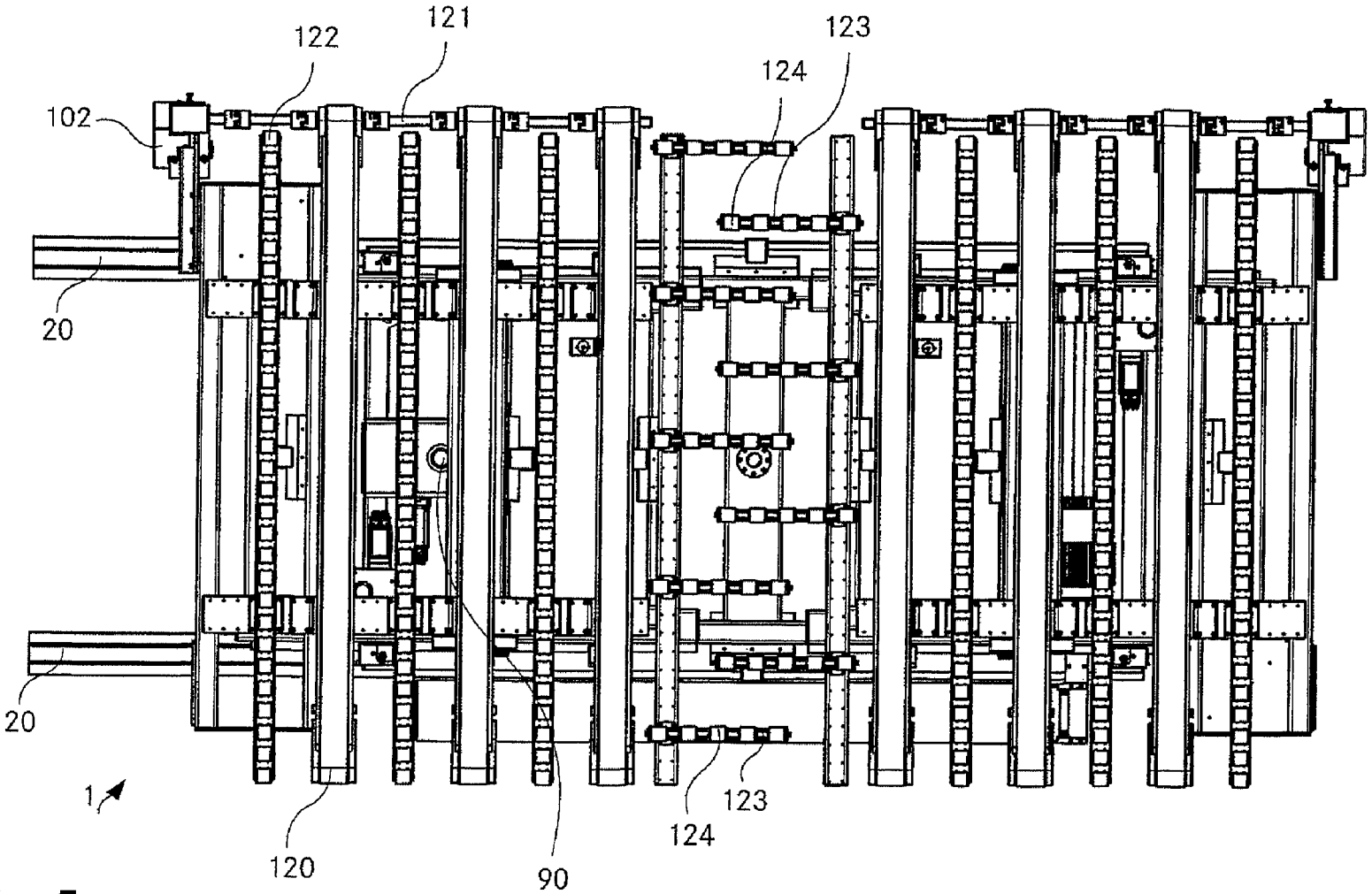
FIG. 5 shows a first plan view of the support level of the centering device.
Figure 6:
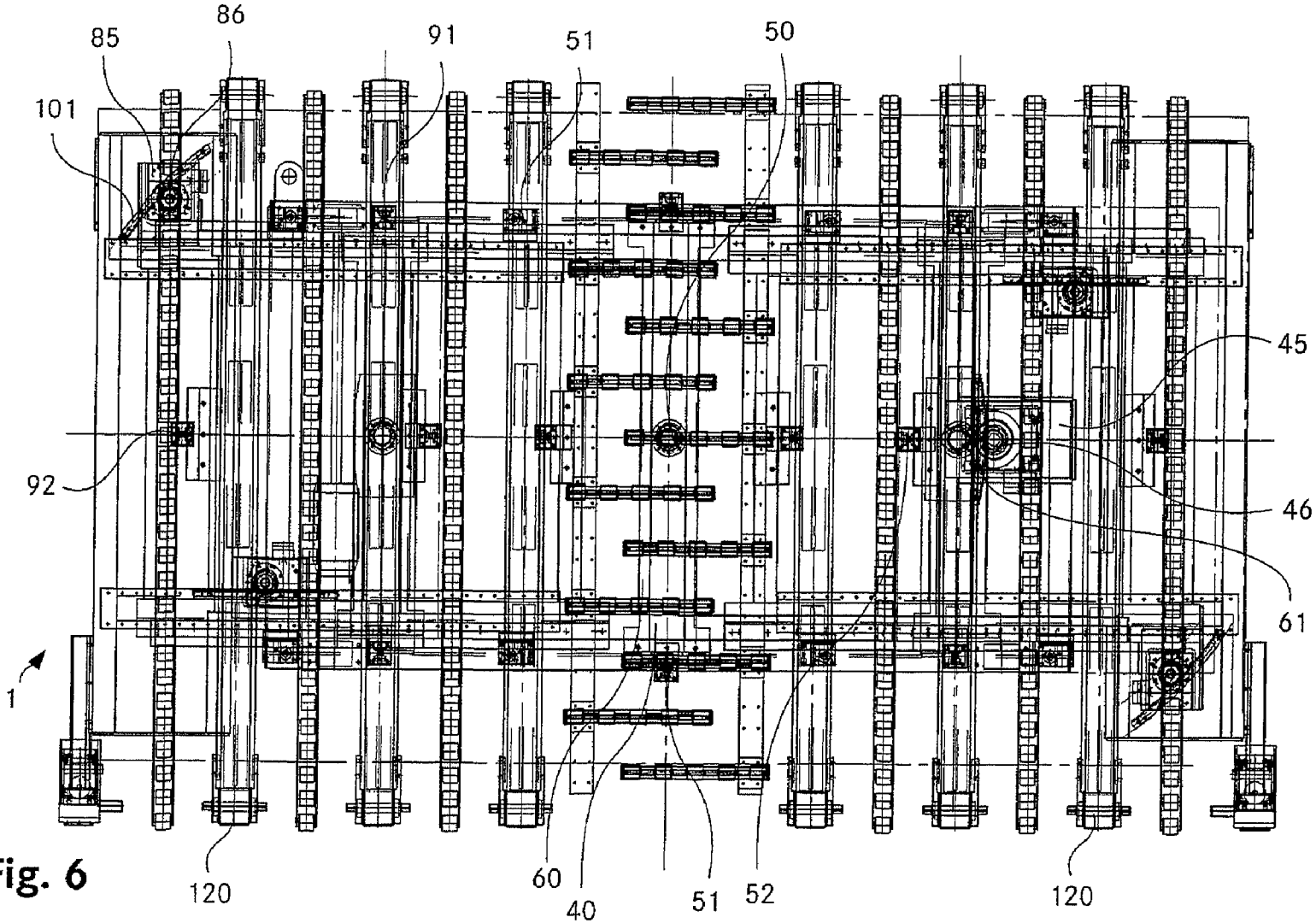
FIG. 6 shows a second plan view of the support level of the centering device.

FIGS. 1-6 show various views of a centering device according to the invention. FIG. 1 shows a first oblique view of the centering device, seen from above, while FIG. 2 shows the oblique view from below. FIGS. 3 and 4 show elevations in a direction transverse to the feed direction (also referred to below as transverse direction) and in the feed direction (also referred to below as longitudinal direction) respectively. FIG. 5 shows a plan view of the support level of the centering device, while FIG. 6 shows fundamentally the same view, although the elements of the device are represented as transparent to enable all levels of the device to be seen simultaneously.

Working from the bottom upwards, the centering device 1 comprises a plurality of levels, situated one above the other (see, for example, FIGS. 3, 4). The lowest level 2 is formed by two parallel rails 20 fastened to the floor and running in a transverse direction. The next level 4 up comprises a horizontally oriented rectangular frame 40, which can be moved in a linear manner along the rails 20, i.e. in a transverse direction. The possibility of such movements is advantageous, especially when carrying out maintenance work. A support 60, likewise rectangular, is mounted on the frame 40 in such a way that it can be rotated about a vertical axis 50, which passes through the geometrical centers of the frame 40 and of the support 60. The support 60 forms the next level 6 up. Two rectangular carriages 80.1, 80.2 of identical construction are mounted on this support 60, the carriages 80.1, 80.2 being movable independently of one another in a linear manner, in a transverse direction relative to the support 60. Tables 100.1, 100.2 are mounted in such a way that they can be rotated about respective vertical axes 90 on each of the carriages 80.1, 80.2, which together form another level 8. The axes of rotation 90 pass through the geometrical centers of the carriages 80.1, 80.2 and of the respective tables 100.1, 100.2. The tables 100.1, 100.2 are on a common level 10. Finally, a plurality of mobile magnetic belts 120 extending in a longitudinal direction (i.e. in the feed direction), which form the uppermost level 12, the support level of the centering device 1, are arranged on both tables 100.1, 100.2.

To enable the frame 40, which is constructed from steel I-section profiles, to be moved along the rails 20, respective roller guides 41, the rollers of which can roll on the corresponding rail 20, are arranged on each of its transverse profiles, in the region of its corners. The roller guides 41 and the rails 20 thus form a linear guide for the frame 40. Attached to the underside of the frame 40 there is furthermore an electric drive motor 42, which is coupled to two of the roller guides 41 by a transmission 43 and a shaft 44 (see FIG. 2). The drive motor 42 is supplied with control signals and with current by means of a drag chain 21 arranged to the side of the transverse profile of the frame 40. With the exception of the rails 20 fastened to the floor, the drive motor 42 can thus be used to drive all the levels 4, 6, 8, 10, 12 situated above (including, in particular, the support level of the centering device 1) jointly, i.e. simultaneously and by the same amount, in a transverse direction.

The support 60 is connected to the frame 40, on the one hand, by the vertically oriented axis 50 which passes both through the geometrical center of the support 60 and through that of the frame 40, the axis 50 permitting a relative rotation between the support 60 and the frame 40. Pitching movements of the support 60 relative to the frame 40 are prevented by respective pairs of roller guides 51, 52, which are situated opposite one another and are spaced apart from the axis 50 on both sides in the transverse and in the longitudinal direction. They comprise pairs of rollers, each attached to the frame 40, the axes of rotation of the rollers being horizontal and pointing towards the axis 50, and a rail guided between the rollers and attached to the support 60. Opposite rollers of the roller guides 51, 52 are set in such a way relative to one another that the rails are guided essentially without play in a vertical direction. Moreover, the roller guides 51, 52 are dimensioned in such a way that there is a certain play between the rails and the boundaries of the roller support in a horizontal plane, this play allowing unhindered rotation of the support 60 about the axis 50 by the required amount (a maximum of about 5° to position workpieces in the case of common applications).

To bring about the rotary motion between the frame 40 and the support 60, an electric drive motor 45 is attached to the top side of the frame 40, this drive motor likewise being controlled and supplied with current by means of the drag chain 21 mentioned. The drive motor 45 acts on a pinion 46, which interacts with an externally toothed gear segment 61 arranged in a fixed manner on the support 60 (see FIG. 6). Both the pinion 46 and the gear segment 61 are arranged on the frame 40 and on the support 60, respectively, at a distance from the axis 50 in a transverse direction. The arrangement of the guides 51, 52, the pinion 46 and the gear segment 61 ensures good support for the support 60 on the guides, and the forces required to rotate the support 60, which have to be transmitted to the gear segment 61 by the pinion 46, are small owing to the lever arm present. Moreover, the guides 51, 52 are positioned in such a way that a minimal play in the longitudinal and transverse directions, in comparison with other positions, is sufficient to allow the rotary motion of the support 60.

A set of four roller guides 62 is arranged on both sides of the support 60, on the outer sides in the feed direction. As is clearly visible in FIGS. 2 and 3, these are attached to brackets 63 attached to the side of the support 60 and they project upwards beyond the support 60. Each roller guide 62 comprises two rollers, one above the other, which can be rotated about horizontal axes of rotation extending in the feed direction. Guided between these rollers are rails 81, which are attached to the underside of the carriages 80.1, 80.2. A set of four roller guides 62 interacts with each carriage 80.1, 80.2, thus enabling a transverse motion of the carriage 80.1, 80.2 relative to the support 60. These linear movements are brought about by two electric drive motors 64, one motor being arranged on the support 60 in the region of each carriage 80.1, 80.2. The drive motors 64 drive a pinion 65, which interacts with a rack 82 attached to the respective carriage 80.1, 80.2 (see FIGS. 2, 3).

The two carriages 80.1, 80.2 are of essentially identical construction and have the same functionality. Unless otherwise stated, the following details relating to the carriages 80.1, 80.2 and elements mounted on them thus apply equally to both carriages 80.1, 80.2.

The support 100 is connected to the carriage 80, on the one hand, by the vertically oriented axis 90 which passes both through the geometrical center of the table 100 and through that of the carriage 80, the axis 90 permitting a relative rotation between the table 100 and the carriage 80. Pitching movements of the table 100 relative to the carriage 80 are prevented by respective pairs of roller guides 91, 92, which are situated opposite one another and are spaced apart from the axis 90 on both sides in the transverse and in the longitudinal direction. They comprise pairs of rollers, each attached to the carriage 80, the axes of rotation of the rollers being horizontal and pointing towards the axis 90, and a rail guided between the rollers and attached to the table 100. Opposite rollers of the roller guides 91, 92 are set in such a way relative to one another that the rails are guided essentially without play in a vertical direction. Moreover, the guides 91, 92 are dimensioned in such a way that there is a certain play between the rails and the boundaries of the roller support in a horizontal plane, this play allowing unhindered rotation of the table 100 about the axis 90 by the required amount (a maximum of about 5° in the case of common applications).

To bring about the rotary motion, an electric drive motor 85 is attached in the region of a corner of the carriage 80 that is on the outside in a transverse direction, this drive motor acting on a pinion 86, which, for its part, interacts with an internally toothed gear segment 101 arranged in a fixed manner in the corresponding corner region of the table 100 (see FIG. 6). The arrangement of the guides 91, 92, the pinion 86 and the gear segment 101 ensures good support for the table 100 on the guides 91, 92, and the forces required to rotate the table 100, which have to be transmitted between the pinion 86 and the gear segment 101, are small owing to the lever arm. Moreover, the guides 91, 92 are positioned in such a way that a minimal play in the longitudinal and transverse directions, in comparison with other positions, is sufficient to allow the rotary motion of the table 100.

Three magnetic belts 120 known per se, which revolve in a longitudinal direction, are arranged on the upper side of the table 100. They are driven jointly by a shaft 121, around which the magnetic belts run at one of their ends. The shaft 121 is driven via a transmission 102 by an electric drive motor 103, which is arranged on the table 100. With the aid of the magnetic belts 120, a workpiece fed in from the feed direction on the support level can be received by the table 100 and positioned in a longitudinal direction. Rows of freely rotatable rollers 122, each parallel to the magnetic belts 120, are arranged between adjacent magnetic belts 120 and to the outside of the magnetic belt 120 which is outermost in a transverse direction, the rollers 122 being arranged in such a way that, together with the magnetic belts 120, they form a continuous supporting surface. The rollers 122 prevent large-area workpieces of low rigidity from sagging; however, owing to their low rolling resistance, they allow unhindered longitudinal transport of the workpiece on the table 100.

As can be seen most clearly from FIG. 5, a plurality of horizontal shafts 123 which extend transversely inwards beyond the dimensions of the tables 100.1, 100.2 themselves are attached to both tables 100.1, 100.2 in the region of the adjacent longitudinal sides of the tables 100.1, 100.2. Each of the shafts 123 carries a plurality of freely rotatable rollers 124 and they are arranged in such a way on the tables 100.1, 100.2 that shafts 123 of one table 100.1 alternate with shafts 123 of the other table 100.2 in a longitudinal direction, i.e. there is a kind of meshing between the shafts 123. The rollers 124 held on the shafts 123 form a supporting surface situated between the tables 100.1, 100.2, the said surface lying in the same plane as the supporting surfaces of the two tables 100.1, 100.2. They can thus prevent workpieces from sagging between the two tables 100.1, 100.2. However, relative rotary movements of the tables 100.1, 100.2 within the necessary range (typically up to 5°) are not hindered, owing to the meshed arrangement. Moreover, the length of the shafts 123 is chosen so that, on the one hand, they do not collide with the opposite table 100 when the two tables are closest together and, on the other hand, they remain meshed at all times when the two tables 100.1, 100.2 are furthest apart, that is to say no gap arises in the supporting surface in a transverse direction between the two tables 100.1, 100.2.

Figure 7A:
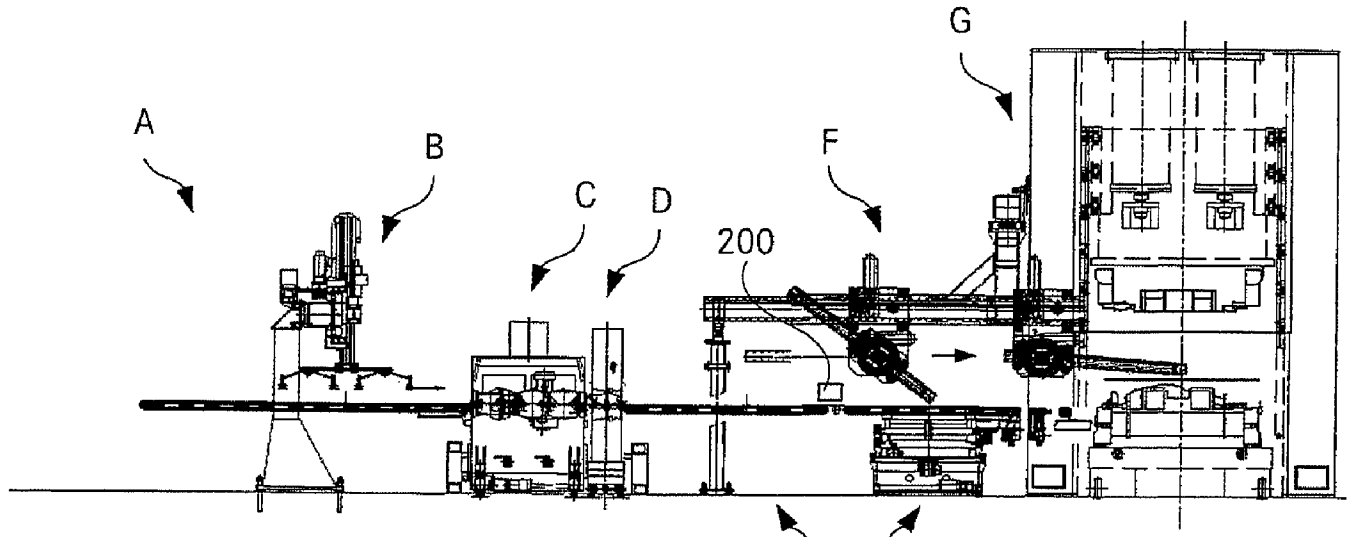
FIG. 7A, B show an elevation and a plan view of the centering device plus upstream and downstream stations.

FIGS. 7A, B show an elevation and a plan view, respectively, of the centering device 1 and of upstream and downstream stations. These stations are known per se and no details will therefore be given below. In the feed direction, the stations comprise first of all a supply table A, on which the workpieces (blanks) to be processed can be deposited by means of a first feeder B. The supply table is provided with conveying means for moving the workpiece in the feed direction, in particular with a series of magnetic belts running in a longitudinal direction. With the aid of these conveying means, the workpiece is first of all transported through a washing unit C and an oiling device D, and then to another conveyor table E, which is again provided with conveying means for longitudinal transport. A line scanner 200 is arranged at the exit of the conveyor table E, extending transversely across the entire transport track of the workpieces. Suitable units for line scanners of this kind, with a light source and a camera, are available from Tichawa Vision GmbH, Friedberg (Germany), for example. In the washing unit C, the workpiece is cleaned and then oiled in the oiling device D; the line scanner 200 detects a light/dark profile of the workpiece line by line by means of an incident-light unit. From the conveyor table E, the workpiece is moved directly to the centering table 1, where it is taken over by the magnetic belts described above and moved in a longitudinal direction until it is completely on the tables of the centering device 1.

After the centering operation, which is described in detail below in conjunction with FIG. 8, the workpiece is removed from the tables of the centering device 1 and placed in the first press station G of a multi-station press by a loading robot F, which is fitted with a gripper unit. With this arrangement, it is possible to process two smaller workpieces in parallel instead of a single workpiece. For this purpose, these workpieces are deposited next to one another on the supply table, moved through the washing unit C, the oiling device D and the line scanner 200 and onto the two tables of the centering device 1 in parallel, where they are each individually positioned and oriented correctly and finally placed jointly in the first press station G by the loading robot F.

FIGS. 8 A-D show schematic representations of a method according to the invention for centering workpieces. The figures each show the supply table A, the adjoining washing unit C, the oiling device D, the conveyor table E, which once again follows on from them, with the line scanner 200, and the centering device 1, which follows on immediately from the conveyor table E and from which the aligned and positioned workpiece can be removed by a loading device (not shown) and transported into a first processing station while maintaining the correct orientation.

Figure 8A:
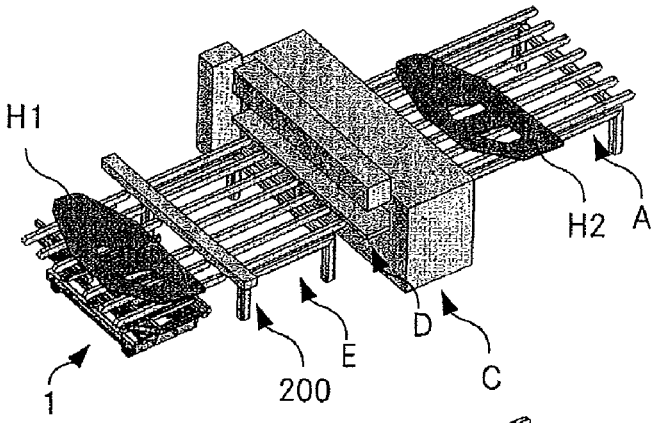
FIG. 8A-D show schematic representations of a method according to the invention for centering workpieces.
Figure 8B:
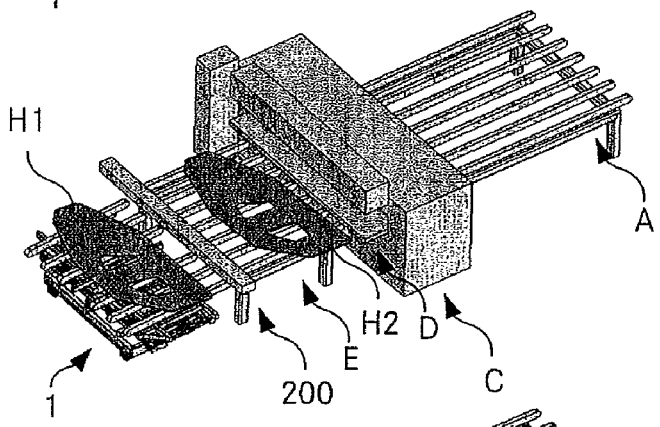
Figure 8C:
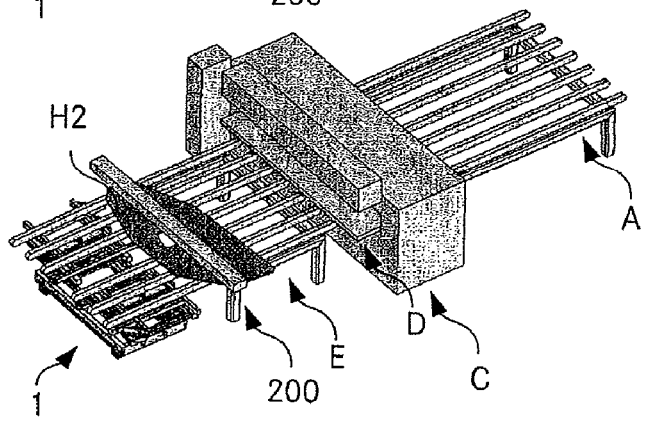
Figure 8D:
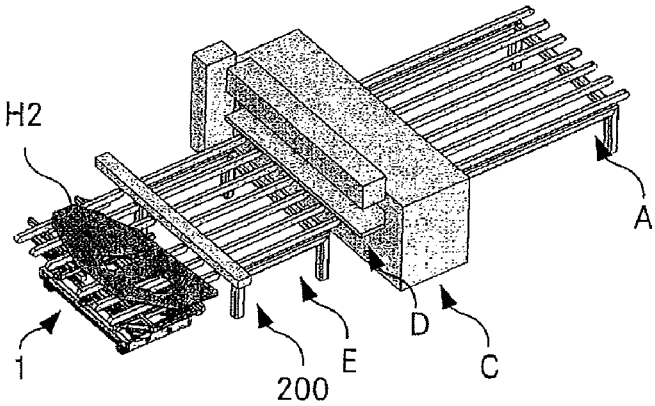

In the situation illustrated in FIG. 8A, a first workpiece H1 (blank), in the present case a side piece of a passenger car body, is on the centering table 1, which is still in the starting position. The next workpiece H2, an identical body side piece, has already been placed on the supply table A. Next, the position and orientation of the workpiece H1 are corrected. For this purpose, the carriages 80.1, 80.2 of the centering device 1 are moved in synchronism in a transverse direction relative to the support 60 in order to achieve a correction in a transverse direction. For this purpose, the corresponding axes of the drive motors 64 are coupled in the control system. Correction in a longitudinal direction is accomplished by means of the magnetic belts 120 (which are moved synchronously for both tables 100); correction of the orientation is accomplished by rotating the support 60 relative to the frame 40 about the axis of rotation 50 (see FIGS. 1-6). Because there is only one workpiece to position in the present case, the remaining rotation and linear axes of the centering device 1 are held stationary.

As the first workpiece H1 is being centered, the second workpiece H2 is transported through the washing unit C and the oiling device D and onto the conveyor table E, where it is transported onwards in the feed direction by means of magnetic belts. This results in the situation illustrated in FIG. 8B.

As the operation continues, the first workpiece H1 is picked up from the centering device 1 by the loading device and fed to the first processing station. As soon as the workpiece H1 has been picked up, the centering device 1 returns to its starting position, in which the frame 40 is in its center position and in which the longitudinal direction of the frame is aligned parallel to the feed direction. The second workpiece H2 is then moved through the line scanner 200. During this process, the workpiece H2 passes through an incident-light unit, which comprises an elongate light source or a series of light sources arranged on one side of the transport track, and a corresponding elongate detection unit (camera) arranged on the same side of the transport track. Because the workpiece H2 only partially reflects the light emitted by the light source as it passes through the line scanner 200, the detection unit can thus be used to record a light/dark profile of the workpiece line by line. Once the workpiece has passed through the line scanner 200, there is a complete image of the inner and outer contours of the workpiece H2 available in a control system (not shown).

This image is then compared with a predetermined desired profile in the control system. The corrections to be carried out are determined from this comparison. These include a linear movement in a transverse direction, a linear movement in a longitudinal direction and a rotation about a vertical axis.

The workpiece H2 is then transported onwards by means of the magnetic belts of the conveyor table E and the centering device 1 until it is completely on the centering device 1, which is still in the starting position. The workpiece H2 is then centered in a manner dependent on the corrections which have been determined. This operation proceeds in the manner described above for workpiece H1. The process is continued by placing another workpiece on the supply table A, giving rise once more to the situation illustrated in FIG. 8A. The process under consideration thus allows continuous, fully automatic feeding, cleaning, detection and positioning of workpieces requiring further processing.

Where relatively small workpieces whose extent in the transverse direction is less than half that of the press are being processed, two workpieces at a time can be processed with the device according to the invention. For this purpose, these workpieces are deposited side by side on the supply table A and are moved through the washing unit C, the oiling device D and the line scanner 200 in parallel. The line scanner detects two light/dark profiles and matches these individually to two desired profiles. Two sets of correction values (transverse and longitudinal positioning, angle correction) are thus obtained. The two workpieces then pass to the two tables of the centering device 1.

To perform the corrections, the centering device is operated in a different operating mode, in which the axis of rotation 50 between the frame 40 and the support 60 is held stationary and in which the coupling of the transverse movements of the carriages 80.1, 80.2 within the control system is dispensed with. Instead, the axes of rotation 90 between the carriages 80.1, 80.2 and the tables 100.1, 100.2 are used, and the linear axes between the support 60 and the carriages 80.1, 80.2 are operated independently of one another (see FIGS. 1-6). Correction in a longitudinal direction is again performed by means of the magnetic belts 120, although in this case the belts are likewise moved independently of one another for each of the tables 100.1, 100.2. As soon as each of the workpieces has been correctly positioned and oriented, they can be picked up by the loading device and transported into the first processing station.

Figure 7B:
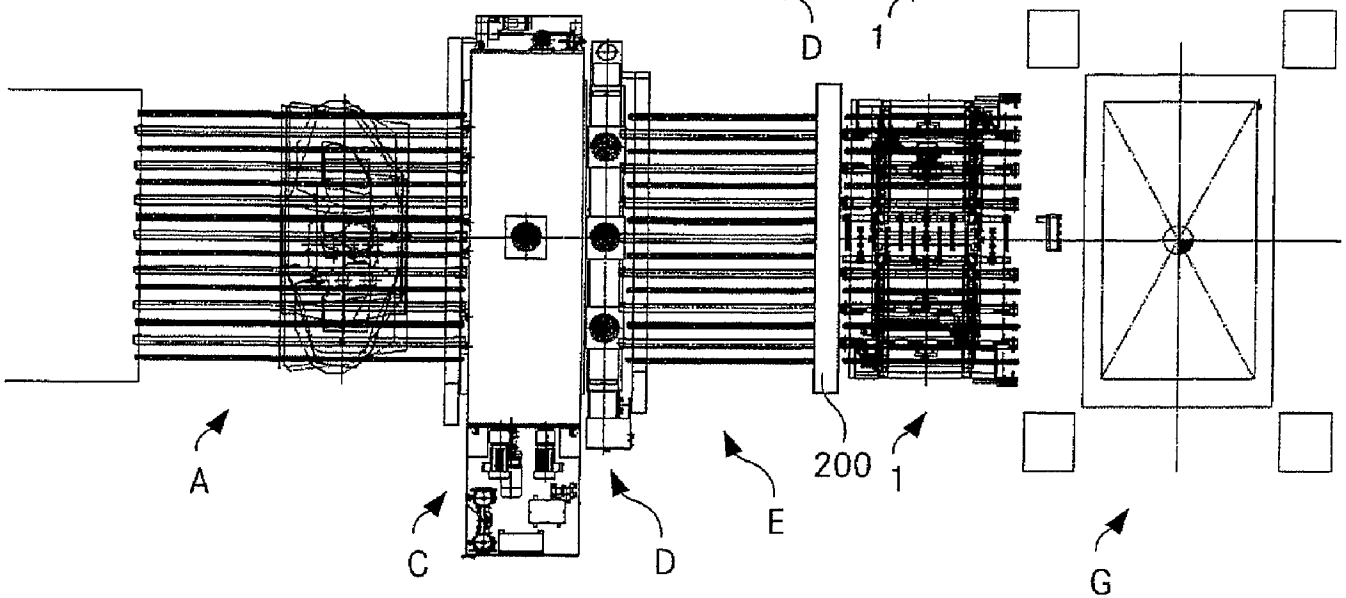

The desired profile, which specifies the position and orientation of the workpiece on the supporting surface of the centering device 1 can be generated as follows: first of all, the workpiece is placed in the first press station F in the correct orientation (see FIGS. 7A, 7B). The loading robot F then runs through its (preset) work cycle in reverse, removing the workpiece from the press station G and depositing it on the supporting surface of the centering device 1. The loading robot F is designed in such a way that there is a precise relationship, which can be preset, between the pick-up and the set-down position and between the pick-up and set-down orientation of the workpiece (it is not essential that the orientation should be maintained).

Next, the workpiece is moved backwards through the line scanner 200 with the aid of the magnetic belts of the centering device 1 and of the conveyor table E, the travel counter to the feed direction being detected in this process. Otherwise, the centering device 1 remains passive, i.e. does not perform any transport movements in a transverse direction or any rotary movements. In the line scanner 200, the profile of the workpiece is detected. This then directly forms the desired profile, which is used to determine the correction values. In addition to the actual desired profile, the abovementioned travel is also included in the calculation; the corresponding value is thus communicated to the control system of the centering device 1 together with the desired profile.

The invention is not limited to the exemplary embodiment illustrated. In particular, it can also be generalized to include facilities with more than two parallel tables. For this purpose, the lower levels can be of identical construction to those in the example illustrated, while more than two carriages with the corresponding higher levels are arranged on the support.

Moreover, the two operating modes can be implemented differently. Instead of immobilizing some of the axes in each case, depending on the operating mode, it is possible to employ further axes in both operating modes in addition to the device for longitudinal transport. Thus, for example, it is also possible in the operating mode in which a plurality of workpieces are positioned in parallel, to employ those axes which rotate both tables jointly about a central vertical axis, or another dynamic axis is provided by means of which both carriages can be moved jointly in a transverse direction, e.g. by designing the linear axis between the floor-mounted rails and the frame as a dynamic axis. This is advantageous especially when a certain proportion of the necessary correction movements coincide for both workpieces and when particularly high dynamism is required. Positioning can thus be optimized by employing the additional axes.

Furthermore, it should be noted that it is not essential that all the rotational and linear axes described should be implemented and that their sequence, arrangement and/or orientation may differ from the embodiment shown. The design of the detection unit may also be different; thus, for example, a transmitted-light unit may be employed instead of an incident-light unit.

In summary, it may be stated that the invention provides a centering device which is of simple construction and can re-orient a number of workpieces simultaneously.

| List of references | |
|---|---|
| A | Supply table |
| B | Feeder |
| C | Washing unit |
| D | Oiling device |
| E | Conveyor table |
| F | Loading robot |
| G | Press station |
| H1 | Workpiece |
| H2 | Workpiece |
| 1 | Centering device |
| 2 | Level |
| 4 | Level |
| 6 | Level |
| 8 | Level |
| 10 | Level |
| 12 | Level |
| 20 | Rail |
| 21 | Drag chain |
| 40 | Frame |
| 41 | Roller guide |
| 42 | Drive motor |
| 43 | Transmission |
| 44 | Shaft |
| 45 | Drive motor |
| 46 | Pinion |
| 50 | Axis |
| 51 | Roller guide |
| 52 | Roller guide |
| 60 | Support |
| 61 | Gear segment |
| 62 | Roller guide |
| 63 | Bracket |
| 64 | Drive motor |
| 65 | Pinion |
| 80, 80.1, 80.2 | Carriage |
| 81 | Rail |
| 82 | Rack |
| 85 | Drive motor |
| 86 | Pinion |
| 90 | Axis |
| 91 | Roller guide |
| 92 | Roller guide |
| 100, 100.1, 100.2 | Table |
| 101 | Gear segment |
| 102 | Transmission |
| 103 | Drive motor |
| 120 | Magnetic belt |
| 121 | Shaft |
| 122 | Roller |
| 123 | Shaft |
| 124 | Roller |
| 200 | Line scanner |

The invention claimed is:

1. A Centering device for flat workpieces, especially sheet-metal blanks to be processed in a press, comprising a) a first table, which can be rotated about a first vertical axis, for receiving a workpiece;

b) a second table, which can be rotated about a second vertical axis, for receiving a workpiece, the second table being arranged to the side of the first table, and a support level of the first table coinciding substantially with a support level of the second table; and c) a rotation mechanism, which is coupled mechanically to the first table and to the second table in such a way that the first and the second tables can be rotated jointly about a third vertical axis, wherein the first table and the second table comprise a device for linear movement of the workpieces in a direction transverse to a feed direction.

2. The Centering device according to claim 1, comprising a control system which can be switched between a first operating mode and a second operating mode, orientation of large workpieces supported by both tables being performed by rotating both tables about the third axis in the first operating mode, and two relatively small workpieces, each supported by one of the tables, being oriented simultaneously in the second operating mode by a procedure in which angular positioning of the two workpieces is performed independently by rotating the tables about the first and the second axes respectively.

3. The Centering device according to claim 1 or 2, wherein the rotation mechanism is formed by a support which is mounted on a machine frame in such a way that it can be rotated about the third vertical axis and which supports both the first table and the second table.

4. The Centering device according to claim 1, wherein the first table and the second table are mounted on the rotation mechanism in such a way that they can be moved transversely.

5. The Centering device according to claim 1, wherein the first table and the second table comprise a device for linear movement of the workpieces in the feed direction.

6. The Centering device according to claim 5, wherein the device for linear movement of the workpieces in the feed direction is formed by magnetic belts.

7. The Centering device according to claim 1, wherein the two tables have spaced supporting elements, each arranged on one side in mutually opposite sections, which are arranged in such a way that they mesh in a region between the two tables and thereby form a supporting surface between the tables.

8. The Centering device according to claim 1, wherein a detection device for detecting a position and an orientation of a workpiece is supplied.

9. The Centering device according to claim 8, wherein the detection device is formed by a line scanner, which is arranged ahead of the first and the second tables in the feed path of the workpieces and extends in a transverse direction across a feed track for the workpieces.

10. The Centering device according to claim 9, comprising a control device which is designed and programmed in such a way that it can use a light/dark profile of a workpiece detected by the line scanner to determine a position correction and angle correction to be performed by means of the rotatable tables.

11. A method for setting up a desired profile of a workpiece on a centering device, comprising the following steps:

a) providing a centering device for flat workpieces, especially sheet-metal blanks to be processed in a press, comprising i) a first table, which can be rotated about a first vertical axis, for receiving a workpiece;

ii) a second table, which can be rotated about a second vertical axis, for receiving a workpiece, the second table being arranged to the side of the first table, and a support level of the first table coinciding substantially with a support level of the second table; and iii) a rotation mechanism, which is coupled mechanically to the first table and to the second table in such a way that the first and the second tables can be rotated jointly about a third vertical axis, wherein the first table and the second table comprise a device for linear movement of the workpieces in a direction transverse to a feed direction, and a detection device for detecting a position and an orientation of a workpiece is supplied;

b) placing a workpiece of a type to be centered in a target position in a processing station arranged downstream of the centering device;

c) transporting the workpiece across the centering device and through the detection device counter to the feed direction by operating transport devices assigned to the processing station, the centering device and/or the detection device in reverse;

d) detecting a position and an orientation of the workpiece by means of the detection device and producing a desired profile, which corresponds to the detected position and orientation of the workpiece.

* * * * *